United States Patent [19]

Pavie

[11] Patent Number: 4,615,446

[45] Date of Patent: Oct. 7, 1986

[54] SORTING MACHINE

[75] Inventor: Claude Pavie, Houilles, France

[73] Assignee: HBS, Bourg Les Valence, France

[21] Appl. No.: 675,592

[22] Filed: Nov. 28, 1984

[30] Foreign Application Priority Data

Dec. 2, 1983 [FR] France ..... 83 19 319

[51] Int. Cl.[4] ..... B07C 1/04

[52] U.S. Cl. ..... 209/583; 198/347; 198/365; 209/900; 271/3.1; 271/9; 271/163; 271/240; 364/478

[58] Field of Search ..... 209/552, 583, 584, 900; 198/347, 365; 271/3.1, 9, 163, 290; 364/478

[56] References Cited

U.S. PATENT DOCUMENTS

| | | | |
|---|---|---|---|
| 3,452,509 | 7/1969 | Hauer | 209/900 |
| 3,815,897 | 6/1974 | Hoehl et al. | 271/9 |
| 3,986,596 | 10/1976 | Hamilton | 198/365 |

FOREIGN PATENT DOCUMENTS

| | | |
|---|---|---|
| 1235817 | 3/1967 | Fed. Rep. of Germany . |
| 2742802 | 4/1979 | Fed. Rep. of Germany . |
| 1402602 | 5/1965 | France . |
| 2194491 | 3/1974 | France . |
| 870719 | 9/1978 | France . |
| 396483 | 1/1966 | Switzerland . |

*Primary Examiner*—David A. Scherbel
*Assistant Examiner*—Donald T. Hajec
*Attorney, Agent, or Firm*—Sughrue, Mion, Zinn, Macpeak, and Seas

[57] ABSTRACT

In an enhanced throughput sorting machine objects injecting by two injectors working in parallel are sorted in two sorting lines also in parallel. The machine incorporates a routing unit to direct the objects from each injector to the relevent sorting line and a dynamic storage system for halting the advance of an object when the objects injected by the two injectors are for the same sorting line.

5 Claims, 9 Drawing Figures

FIG.2

| n° | INJECTOR 1 | INJECTOR 9 | SORTING LINE | DYNAMIC STORAGE 19 | DYNAMIC STORAGE 20 |
|---|---|---|---|---|---|
| 1 | X | Y | X Y | | |
| 2 | X | X | X | X | |
| 3 | Y | X | Y X | | |
| 4 | Y | Y | Y X | | Y |
| 5 | X | X | X Y | X | |
| 6 | X | Y | X Y | | |

FIG.8

| n° | INJECTOR 1 | INJECTOR 9 | INJECTOR 82 | SORTING LINE | DYNAMIC STORAGE 19 | DYNAMIC STORAGE 20 | DYNAMIC STORAGE 86 |
|---|---|---|---|---|---|---|---|
| 1 | X | Y | Y | X Y | | Y | |
| 2 | X | Y | Z | X Y Z | | | |
| 3 | X | X | Z | X Z Y | X | | |
| 4 | X | X | X | X | X X ? | | |
| 5 | X | Y | X | X Y | X | | |
| 6 | Z | Z | Y | X Y Z | | | Z |
| 7 | Z | Y | X | X Y Z | | | |
| 8 | Z | X | X | Z X | X | | |
| 9 | Y | Y | Y | Y X Z | | Y Y ? | |
| 10 | Z | X | Y | X Y Z | | | |
| 11 | Z | Z | Z | X Z | | | Z Z ? |

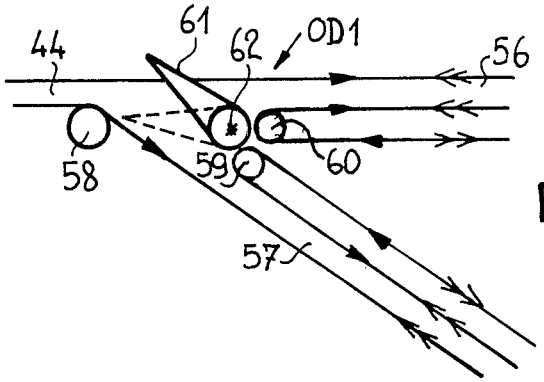
FIG.4
FIG.5
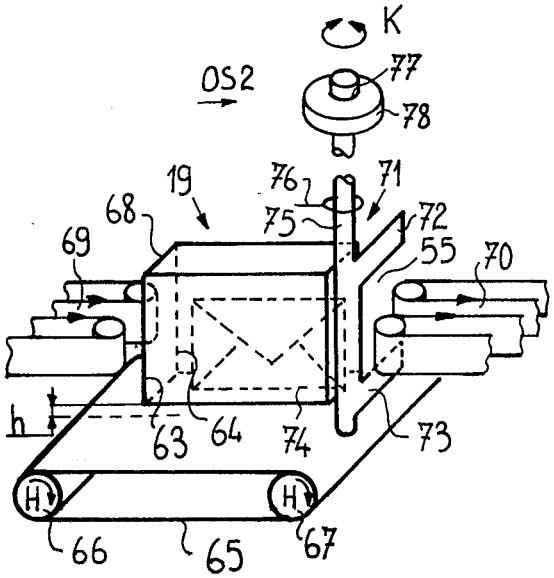
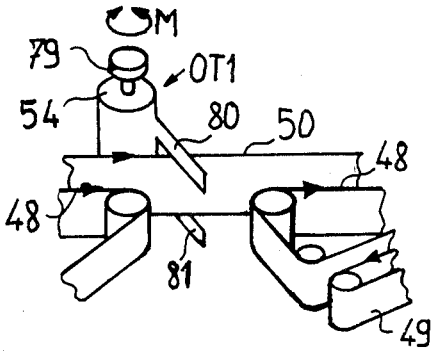
FIG.6

SORTING MACHINE

BACKGROUND OF THE INVENTION

1. Field of the Invention

The invention concerns a sorting machine of enhanced throughput of the type used in sorting mail. However, a machine of this kind may find applications in other fields, in particular in banks for sorting cheques, and generally speaking it may be utilized wherever the problem is raised of distributing batches of objects in large numbers according to their destination.

2. Description of the Prior Art

In the mail field, a sorting machine comprises an injector linked under the control of a control circuit to a plurality of parallel sorting lines. The injector comprises a magazine in which the objects to be sorted are stacked, an extractor to extract the objects one by one from the magazine, and a detector unit adapted to recognize the destination to which each object must be addressed as the objects are extracted. The control circuit receives the detected signals and produces sorting instructions which it sends to the sorting lines. Each sorting line comprises a plurality of receptacles each of which is assigned to a particular destination. The set of receptacles for all the sorting lines covers all possible destinations to which each of the objects may be addressed.

Sorting machines are designed with a nominal throughput. The injector is designed to operate at this nominal throughput. For the machine to operate in a coherent manner it is necessary that the theoretical nominal throughput of each sorting line be at least equal to the nominal throughput of the injector. A single one of the sorting lines is selected for each object sorted. This means that, independently of the speed with which one sorting line is selected from the set of sorting lines, there may be an underutilization of all the sorting lines which have not been selected. There are known sorting machines with eight parallel sorting lines each comprising 24 receptacles. Thus of the 192 possible destinations, only the 24 associated with one sorting line are selected at any particular time. Consequently, all the others are temporarily inoperative. The most expensive units of a sorting machine are the sorting lines and although the nominal throughput of each of them is equal to the throughput of the injector, broadly speaking their actual throughput is multiplied by a factor of 1/N, where N is the number of lines in the machine.

An object of the invention is to alleviate the cited disadvantages by offering a machine equipped with at least one supplementary injector placed in parallel with the first and feeding into the sorting lines. To resolve theproblems of conflicting destinations which arise when two objects from the injectors are intended for the same sorting line, the invention provides for the disposition between these injectors and the sorting lines of means for eliminating any conflict.

SUMMARY OF THE INVENTION

The invention consists in a sorting machine comprising at least two injectors through which objects to be sorted enter the machine, a set of parallel sorting lines, routing stages adapted to link the outlet from each injector to the inlet of each sorting line, respective control means disposed between each injector and said routing stages adapted to sense a destination marker on each object from the respective injector, to designate the sorting line for each object and to command the routing of each object to the appropriate routing stage, and dynamic storage means equipping all except one routing stage of all sorting lines adapted to temporarily store an object from the corresponding injector when the sorting line designated for that object is the same as that designated for another object output by another injector at substantially the same time.

Other objects and advantages will appear from the following description of an example of the invention, when considered in connection with the accompanying drawings, and the other features will be particularly pointed out in the appended claims.

BRIEF DESCRIPTION OF THE DRAWINGS

FIG. 2 is a table of a sequence of events applicable to FIG. 1.

FIGS. 4, 5 and 6 show mechanical details of implementation of certain units from FIG. 3.

FIG. 8 is a table of a sequence of events applicable to FIG. 7.

DESCRIPTION OF THE PREFERRED EMBODIMENTS

Figure 1:
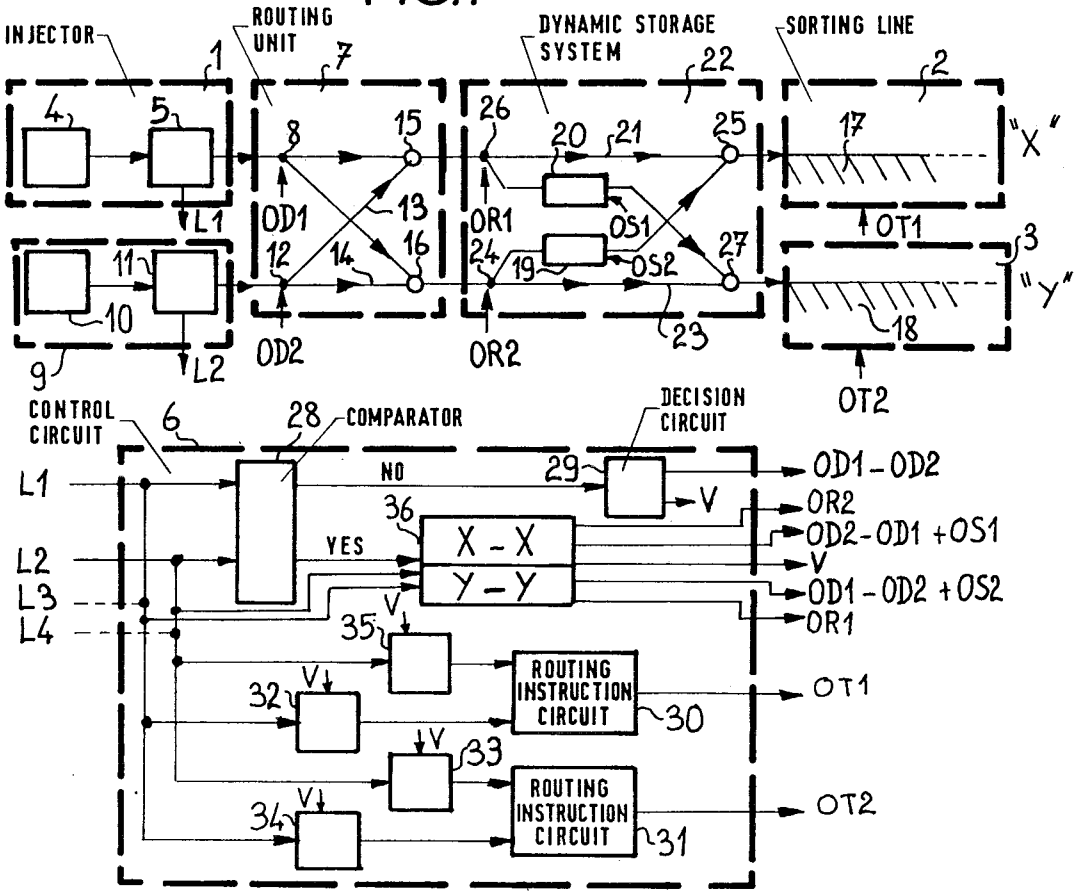
FIG. 1 is a block schematic of a sorting machine in accordance with the invention.

FIG. 1 shows a sorting machine in accordance with the invention. This machine comprises an injector 1 for injecting objects into at least two sorting lines 2 and 3. The injector 1 comprises a magazine for objects associated with an extractor. The objects extracted from the magazine 4 pass before a read head 5, or more generally a detector unit, which sends a signal L1 on reading an index written on one side of the extracted object and facing the rear head. The signal L1 is received by a control circuit 6 which generates a routing instruction OD1 to designate which of the two sorting lines has been selected. A routing unit or stage 7 featuring a bifurcation 8 represented by a dot and receiving the instruction OD1 is used to route the object to be sorted towards the designated sorting line. The circuit 6 also generates a sorting instruction OT1 or OT2 according to the sorting line in question, in order to store the object in its destination receptacle.

In accordance with the invention a second injector 9 similar to the first injector 1 is connected in parallel with the latter to the routing unit 7. This injector 9 also comprises a magazine 10 associated with an extractor and a read head 11 which sends a read signal L2 to the control circuit 6. The injector 9 is supplied with batches of objects for which the range of destinations is similar to that for the objects supplied to injector 1. In the routing unit 7 in series with the injector 9 there is a bifurcation 12 represented by a dot which enables an object injected by the injector 9 to be routed to the sorting line 2 or the sorting line 3. The routing stages 13 and 14 originating from the bifurcation 12 are respectively connected by the junctions 15 and 16 represented by small circles to the paths which link the injector 1 to sorting lines 2 and 3, respectively. If the objects to be stored in the receptacles such as 17 of the sorting line 2 are designated X and those to be stored in the receptacles 18 of the line 3 are designated Y, and if the injector 1 injects an object X at the same time as the injector 9 injects an object Y, the objects are stored in their respective receptacles in lines 2 and 3, respectively, as a result of the routing instructions OD1 and OD2 and the sorting instructions OT1 and OT2. If, subject to the same hypotheses, the injector 1 injects an object Y and the injector 9 an object X, the bifurcations 8 and 12 are switched by the instructions OD1 and OD2 so as to route these objects to sorting lines 3 and 2, respectively.

On the other hand, when both injectors 1 and 9 simultaneously deliver an object of the same type, type X, for example, destined for the same line, line 2, for example, there is a conflict situation. This conflict may result in a double seizure, in which case the two objects are superposed, or the two objects may end up too close together with the distance between them less than the minimum distance dependent on the nominal throughput of the sorting line in question. To eliminate such conflicts, the invention provides dynamic storage means 19 and 20 respectively feeding into sorting lines 2 and 3. In the example given, the store 19 temporarily intercepts objects X injected by the injector 9 and intended for the line 2 whereas a direct routing stage 21 enables the injector 1 to feed its object X directly into line 2. The dynamic storage system 22 thus consists of two direct routing stages 21 and 23, the latter identical to the former and fullfilling the same function except in respect of the injector 9 and sorting line 3, and the two dynamic stores 19 and 20. A bifurcation 24 provides for extracting anobject X from the stage 23. A function 25 provides for inserting this object X delivered by the sotre 19 into the stage 21. A bifurcation 26 and a junction 27 fulfil the same role in relation to the stage 21, the store 20 and the stage 23 in connection with the objects Y.

Without prejudice to the mechanical implementations which will be explained hereinafter, the system of FIG. 1 may function in a slightly different manner. In this variant, the routing unit 7 is eliminated and only the conflict elimination means 22 remain. If the injector 1 injects an object X and the injector 9 an object Y there is no problem. If the injector 1 and the injector 9 both inject an object X or an object Y, these objects will be routed by temporarily holding back one of them in the store 19 or 20 concerned. On the other hand, if the injector 1 injects an object Y and the injector 9 an object X, the routing of these objects to lines 3 and 2, respectively, will be achieved by allowing the objects Y and X concerned to pass through the stores 20 and 19 without temporarily holding them back. This is rendered possible by a specific structure of the stores 19 and 20 to be described hereinafter. It is also rendered possible if the dynamic storage means are of the last-in-first-out (LIFO) type in which case a last object enters and immediately exits a dynamic store of this kind. A possible second variant in terms of operation is to retain the routing unit 7 and the dynamic storage system 22 and to sort fully only X-Y or Y-X configurations and sort only one object of X-X or Y-Y configurations. In the second variant the actual throughput of lines 2 and 3 is not doubled but it is at least equal to and in most cases greater than the actual throughput of the cited prior art. Intuitively it may be assumed that this actual throughput is approximately one and a half times the actual throughput of the cited art.

The control circuit 6 operates in the following manner: the detected signals L1 and L2 are fed to a comparator 28 which determines whether there is a conflict situation or not. In the case where there is no conflict situation (X-Y or Y-X) a decision circuit 29 is activated by the comparator 28. It produces a pair of routing instructions OD1-OD2 addressed to the respective bifurcations 8 and 12 to route the objects towards their respective sorting lines. It also produces a validation signal V which enables the transmission of the signals L1 and L2 to sorting instruction circuits 30 and 31. To this end, the signal V is fed to gates enabling or blocking the transmission of the signals L1 and L2 to the circuits 30 and 31. For example, if L1 relates to an object of type X injected by injector 1 and L2 relates to an object of type Y injected by injector 9, the decision circuit 29 switches the bifurcations 8 and 12 to the appropriate positions by means of the instructions OD1 and OD2 and the polarity of the signal V authorizes the transmission of the signal L1 to the circuit 30 via the gate 32 and of the signal L2 to the circuit 31 via the gate 33. In the opposite case (Y-X) the instructions OD1 and OD2 are interchanged, the polarity of the signal V is inverted, the gate 34 enables the transmission of signal L1 to circuit 31 and the gate 35 enables the transmission of signal L2 to circuit 30. Circuits 30 and 31 are known prior art circuits. Their function is to select a receptacle such as 17 or 18 of one of the sorting lines to receive an object of which the read index (the address) is L1 or L2.

In the case where there is conflict the comparator 28 activates a test circuit 36 which recognizes if the conflict if of the X-X or Y-Y type. In both cases the test circuit 36 delivers identical instructions OD1 and OD2. The objects thus reach two different paths from the outlet of the routing unit 7, that is to say they reach different bifurcations 24 and 26 of the system 22. In the X-X case the object injected by injector 1 passes through stage 21 of the system 22 and the object injected by injector 9 reaches the bifurcation 24, for example. In this case the bifurcation 24 is activated by a blocking instruction OR2 generated by the test circuit 36 so that the object is halted in the store 19. In the inverse Y-Y configuration the object Y injected by injector 1 is halted in the store 20. During this same period the test circuit 36 produces a validation instruction V identical to the preceeding one to operate in the same manner on the gates and the instruction circuits 30 through 35. In both these conflict situations one of the objects is not sorted: this is the function of the second variant.

The table in FIG. 2 shows a sequence of events which may occur. On event number 1, in which an object of type X is injected by the injector 1 and an object Y by the injector 9, the sorting lines 2 and 3 sort the objects X and Y. On event number 2, the object X from the injector 1 is fed into the line 2 whereas the object X injected by the injector 9 is stored in the store 19. On event 3, the routing unit 7 is switched and the objects X and Y are also stored in the sorting lines 2 and 3. On event 4, which is the complement of event 2, the object Y injected by injector 9 is stored in the line 3 whereas the object injected by injector 1 is halted in the store 20. Thus the inactivity of the line 2 may be put to good use to empty the contents of store 19 and route the previously stored object X into this line 2. The specific addressing provisions which enable this latter and previously sorted object X to be sorted correctly will be explained hereinafter. On event 5, which is the complement of event 4, an object X is sorted, the other object X is stored in the store 19 and the content of the store 20 is fed into the line 3. On event 6, identical to event 1, both objects X and Y are sorted and the store 19 continues to hold back the object X whose advance it had impeded.

The taking of the object X out of the store 19 at the time of event 4 and of the object Y out of the store 20 at the time of event 5 is organized by means of a set of extraction instructions OS2 and OS1 also generated by the test circuit 36. In a particularly simple Y-Y configuration, the instruction OS2 to empty the store 19 at the time of event 4 is produced at the same time as the instruction OD2 to route an object Y to the stage 23. At the same time the object Y injected by injector 1 is stored in the store 20 by virtue of the blocking instruction OR1. At the time of event number 5, while the object X injected by injector 1 is sent to the stage 21 by an instruction OD2, an instruction OS1 generated at the same time as OD1 releases the object Y contained in the store 20 towards the sorting line 3. During this same time interval an instruction OR2 conditioning the bifurcation 24 ensures that the object X from the injector 9 is stored in the store 19.

Figure 3:
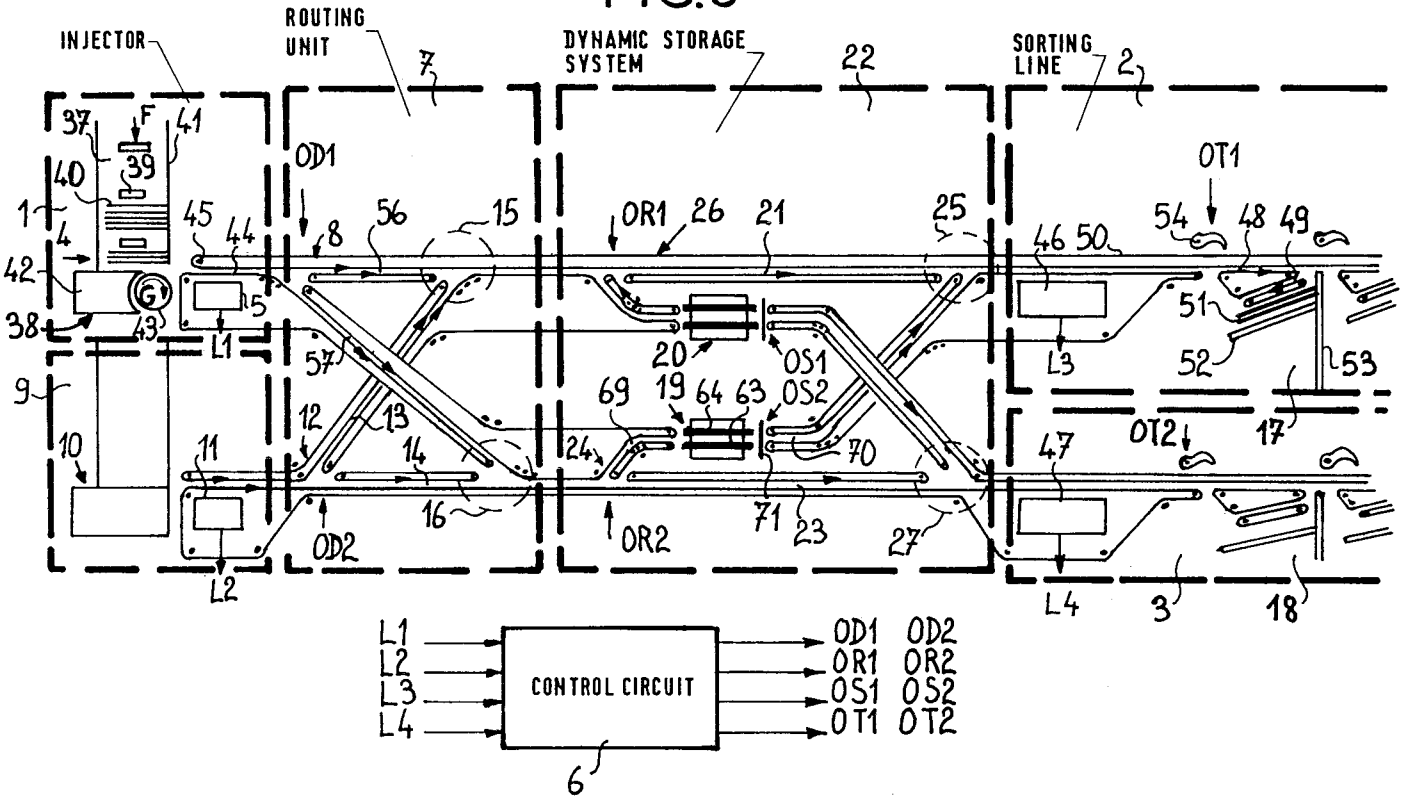
FIG. 3 is a plan view of a sorting machine as per FIG. 1.

FIG. 3 is a view from above of a sorting machine of enhanced throughput implementing the principle represented in FIG. 1. It shows the injectors 1 and 9, the routing unit 7, the conflict avoidance means 22 and the sorting lines 2 and 3. The sorting machine of FIG. 3 represents a mail sorting machine. In mail sorting the objects to be sorted are letter or packets the principal characteristic of which is that they are flat. In this machine all the flat objects are stored, transported and sorted substantially on edge. The magazine 4 comprises a feed device 37 and an extractor 38. The device 37 is of the type described in U.S. Pat. No. 4,167,227. In particular, it comprises a set of retractable fingers such as 39 moving in the direction towards the extractor 38 as shown by the arrow F. The flat objects 40 to be sorted may be placed on edge between these fingers manually. The device 37 further comprises means for aligning the vertical edges of the objects against a jolting member 41. The fingers 39 are retracted in the vicinity of the extractor 38.

The extractor 38 is of the type described in U.S. patent application Ser. No. 466,672, now abandoned. In particular, it comprises a suction chamber 42 against which a first object to be extracted is held and a selectively depressurized hollow drum 43. The drum 43 is of the type which rotates continuously, in the direction of the arrow G; it is provided over its entire periphery with holes communicating with its interior. The holes, disposed on the generatrix of this drum facing the objects to be extracted, are placed in communication with selectively operated vacuum means so that in rotating the drum entrains the first object placed against it and feeds it into a conveyor 44. The vacuum system connected to the suction chamber 42 and to the drum 43 and the means for controlling same are not shown.

In the example shown in FIG. 3 the means for transporting the flat objects consist of conveyor belts enabling the flat objects 40 to be conveyed by virtue of being gripped between two belts in contact with one another. Each of these conveyors is thus defined by two belts over its entire route. The direction of each belt is indicated by arrows which show the circuit that they follow around pulleys such as 45 represented throughout the figure by small dots. Certain of these pulleys are idler pulleys whereas others are motor-driven. It is obvious that the conveyor belts for sorting flat objects may be replaced by pulley conveyors or any other known means when it is a matter of sorting objects other than flat objects. To enable the conveyors to cross over at the routing unit and at the dynamic storage system they may be in different horizontal planes and/or warped at the crossover point. The bifurcations 8, 12, 26 and 24 and the junction 15, 16, 25 and 27 are implemented as shown in FIG. 4. One embodiment of the stores 19 and 20 is shown in FIG. 5.

What distinguishes FIG. 3 from FIG. 1 is the presence at the inlet end of sorting lines 2 and 3 of repective read heads 46 and 47. The benefit of this second set of read heads is to permit the feeding into the sorting lines of objects previously held in the stores 19 and 20. Under these conditions (FIG. 1) it is signals L3 and L4 from this second set of read heads which are fed into the instruction circuits 30 and 31 under the control of the gates 32 and 33. In this case the signals L1 and L2 are not connected to the circuits 30 and 31, of course. The provision of the second set of read heads is equivalent to memorizing the address of the object X or Y throughout the period for which it is held in the respective store 19 or 20. From this point of view, this second set of read heads is equivalent to a memory circuit in the control circuit 60 for the purpose of memorising these addresses.

The receptacles 17 and 18 are preferbly of the type described in U.S. patent application Ser. No. 428,333. They are characterized by an edge stacking device comprising a passage belt 48 and a stacker belt 49. The passage belt 48 is friction driven by a main transport belt, the belt 50 of the sorting line 2, for example. The belt 49 is friction driven by the belt 48. When they are stacked in the receptacle 17 the objects 51 are retained on the side opposite the stack by a vertical retaining plate 52. The belt 49 and the plate 52 are slightly inclined relative to a jolting member 53 against which the stacked objects are aligned. the plate 52 is urged towards the stacker belt 49 by elastic means (not shown). The sorting members such as 54 receiving the sorting instructions OT1 and OT2 are shown in FIG. 6.

FIG. 4 shows the bifurcation 8. This bifurcation splits the conveyor 44 into two conveyors 56 and 57. The belts which form these conveyors run around pulleys 58 through 60 in the direction of the single-headed arrows. A routing flap 61 is rotated about a spindle 62 by a motor (not shown) controlled by the instruction OD1. The flap 61 can assume either of two positions. The position shown in full line is used to deflect an object from the conveyor 44 to the conveyor 57 and the position shown in dashed line is used to allow an object to pass from the conveyor 44 to the conveyor 56. To prevent it hooking onto the deflected objects, the flap 61 has extensions above and below the belt 44 arranged to engage securely against the back of the flat object to be deflected. A junction comprises the same components as a bifurcation apart from the flap 61 and its motor. In this case the directions of the belts are reversed. All objects fed in via the conveyor 56 or 57 are taken up by the conveyor 44. The direction of movement of the belts in a bifurcation is that marked by the single-headed arrows; the direction of movement for a juncton is that shown by the double-headed arrows.

FIG. 5 shows a dynamic store 19. This store 19 is an individual store in that it provides for the temorary storage of one object only. It essentially comprises two guides 63 and 64 held at a small distance h above a circulating endless belt 65. The belt 65 is driven continuously in the direction of the arrows H by pulleys 66 and 67. For support purposes the two guides 63 and 64 may be linked by an upper crossmember 68. The space separating the two guides on one side faces the outlet from a conveyor 69 and on the other side opens onto a conveyor 70 (see also FIG. 3). A barrier 71 comprises two bars 72 and 73 adapted to oppose the advance of an object 74 entrained by the circulating belt 65 on which the lower edge of this object rests. The bars 72 and 73 are separated by a gap 55 which provides for retraction of the barrier 71 by rotation around a spindle 75 without striking the conveyor 70. The spindle 75 secured by bearings such as 76 is coupled to a motor 77 supported by ring 78. In response to an instruction OS2 produced by the circuit 6 the motor 77 rotates the spindle in the direction of the doubleheaded arrow K to enable the barrier to be opened or closed.

Note that the store 19 as described is entirely suitable to implementation of the first variant referred to hereinabove. In this variant the routing unit 7 is combined with the conflict elimination means 22. With the barrier 71 held open, an object fed in by the conveyor 69 passes directly onto the conveyor 70 without halting. In a more general application and for various reasons the store 19 may be replaced with a dynamic storage device of the first-in-last-out type described in U.S. patent application Ser. No. 556,868. In this device the stored objects are kept on edge and are assembled into packets by fingers mounted on carriages disposed at the front and rear of each packet. They are introduced into the device by a stacker situated at its inlet and they are extracted from it by an extractor situated at its outlet. Given these conditions, the extracting instruction for the extractor situated at the outlet from this dynamic storage device is the instruction OS2.

A special feature of this dynamic storage device is that its output can operate independently of what is happening at its input. It can therefore receive and output objects at the same time or accomplish only one of these two actions. As the capacity of this storage device may be of the order of several hundred letters it is entirely possible to operate it according to the second variant referred to hereinabove. That is to say, each time there is a conflict one of the objects generating the conflict is stored in a dynamic storage device. The contents of these dynamic storage devices are subsequently sorted when the injectors are empty or possibly when the dynamic storage devices are themselves full. In the latter case, injection is temporarily halted. In the second phase the throughput of the sorting lines may be the nominal throughput.

FIG. 6 shows a routing flap 54 such as has to be fitted at the inlet of the receptacles 17. The flap 54 driven by a motor 79 can rotate in the direction of the doubleheaded arrow M when it receives a sorting instruction OT1. An object entrained between the belt 50 and the belt 48 of a preceding receptacle comes into contact with extensions 80 and 81 of the flap 54; it is deflected towards the stacker belt 49 of the selected receptacle 17 when these extensions change its route.

Figure 7:
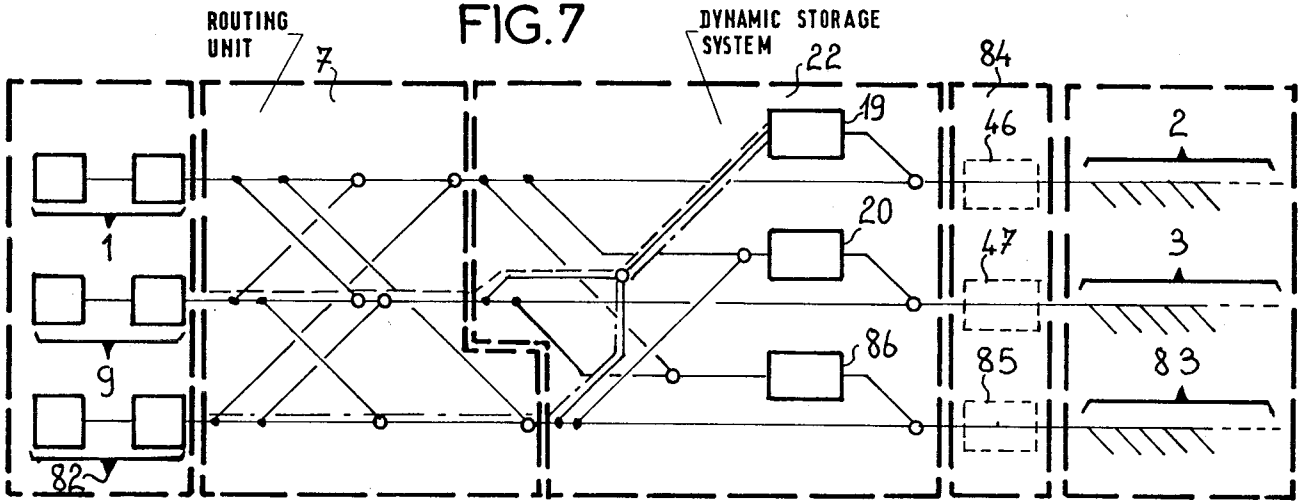
FIG. 7 is a block schematic of a generalized sorting machine in accordance with the invention.

In a generalized version shown in FIG. 7 the enhanced throughout sorting machine may comprise as many injectors as there are sorting lines. There are seen the injectors 1 and 9 as well as an injector 82, serving sorting lines 2, 3 and 83. As with the configuration referred to hereinabove it is possible to install a second set 84 of read heads. This comprises the read heads 46, 47 and 85. The routing units 7 comprises bifurcations and junctions directly facing each injector, equal in number to one less than the total number of injectors. As there are three injectors in this instance there are two bifurcations and two junctions in series with each injector. The reader is reminded that the junctions are represented by small circles and the bifurcations by small dots. In the means 22 for eliminating conflicts there are as many dynamic storage means as there are sorting lines to be serviced. There are seen the previous stores 19 and 20 servicing sorting lines 2 and 3 as well as a store 86 for servicing the sorting line 83.

The table in FIG. 8 represents a sequence of events of the same type as that of FIG. 2 but now relating to three injectors. What takes place during the first three events in this table is in all respects comparable with what has been described previously. On the other hand, a difference arises on the fourth event in which the dynamic storage means 19 receive two objects X at the same time. At the end of event 4 the store 19 thus contains three objects X, that received on event 3 and the two received on event 4. It receives a fourth at the time of event 5. Generalization of the invention may thus result in the need to overcome two problems: providing an individual dynamic store firstly capable of receiving more than one object and secondly capable of receiving these objects at very closely spaced times. On events 6, 7 and 8 the operation of the means 22 is as previously indicated. A difference arises at the time of event number 9. Here a pair of objects YY must be stored in the store 20, as has just been indicated, at the same time as the store 19 outputs an object X to be sorted into the line 2 and the store 86 outputs an object Z to be sorted into the line 83. In the final analysis, this difference does not entail any problems differing from those mentioned previously but indicates that these problems may arise in respect of any of the stores 19, 20 and 86.

Figure 9:
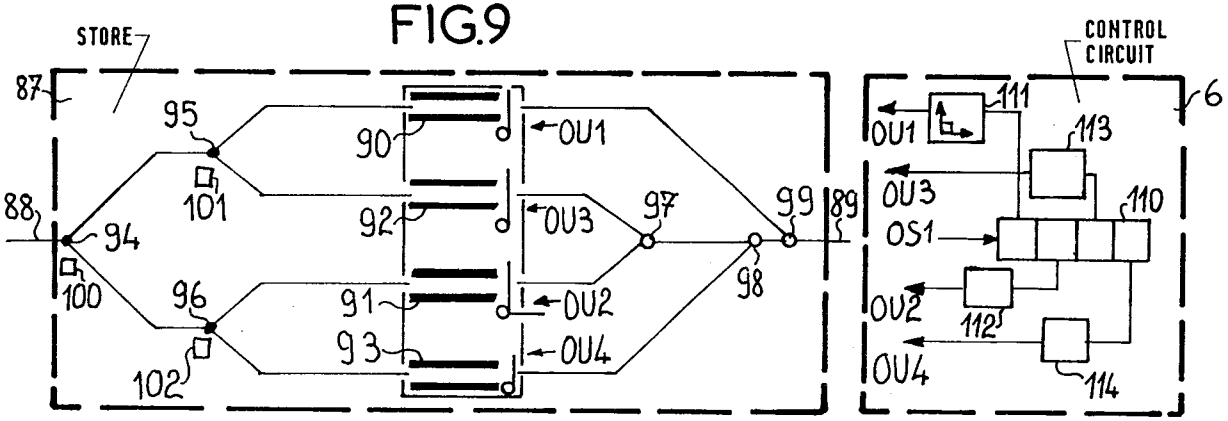
FIG. 9 shows a variant of the dynamic storage means.

FIG. 9 show a store 87 adapted to resolve the problems referred to. This store 87 has an inlet 88 and an outlet 89. Between this inlet and this outlet it is divided into a group of four parallel individual stores 90 through 93, by means of three cascaded bifurcations 94 through 96 and three junctions in series 97 through 99. These bifurcations and these junctions may be of the same type as those shown in FIG. 4. The parallel individual stores may be mounted on a common circulating belt. The stores 90 through 93 are subject to a hierarchy. In one case, for example, the store 90 has priority and takes precedence over the stores 91, 92 and 93. This hierarchy is subject to circular permutation by one step (91, 92, 93, 90) each time that an object is extracted from the priority individual store. This may be achieved by transmitting the instructions OS1 and OS2 through a 4-stage shift register 110. Each of the four stages in turn sends an instruction to individual monostables 111 through 114 to operate the motor of an individual store barrier. The instructions OU1 through OU4 produced by these monostables then temporarily open the barriers before closing them again.

The permutation of the introduction of the objects into the hierarchically organised stores may be achieved by placing a detector such as 100 through 102 at the location of each bifurcation. Each of these detectors switches the position of the routing flap of this bifurcation as soon as it has sensed an object passing it. The link between a detector and its routing flap may be direct, to permit a fast response. An advantage of the arrangement of FIG. 9 is seen in the fact that only the bifurcation 94 need be very fast in operation. Nevertheless, should it happen that the objects of a pair (X-X) to be stored in the same store are too close together and the bifurcation 94 is not fast enough, it is entirely possible to modify the distances separating the store in question from the injectors feeding it. Thus, again with reference to FIGS. 7 and 8, at the time of event 4 the two objects X injected by the injector 9 and the injector 82 follow the paths marked in dashed line before reaching the store 19. Note that the path originating from the injector 82 is longer than the path originating from the injector 9. This means that if the two objects X are injected at the same time, the object X injected by injector 9 will arrive before the object injected by injector 82. It is also possible to modify the routing of the objects in the routing unit 7 in order the vary the distances covered. It is seen that in this way the difficulties referred to hereinabove are resolved. The simplicity of the design of the individual store as described provides for relatively inexpensive adaptation of the number of these individual stores to the statistically determined maximum number of objects which they need to contain during a given sorting phase. However, these problems do not arise when the stores are of the type described in the aforementioned patent application. On the one hand this can store a large number of objects and on the other hand it will even tolerate the injection of overlapping flat objects.

Throughout the foregoing description the injectors operate synchronously and, in order to simplify the explanation, at constant increment. The expression "at constant increment" signifies that the objects are injected by the injectors at a regular rate independent of their size and principally their length. Constant spacing injectors are known. The special feature of these injectors is that the space separating the rear end of one object from the front end of the next object is constant all along the conveyors. The use of injectors of this kind, which are inherently of higher performance than constant increment injectors, is also possible with the device of the invention. Knowing the geometry, that is to say the lengths of the various conveyors, of the machine and knowing the length of the objects injected by each of the injectors, it is sufficient to use a microprocessor to carry out ballistic calculations to determine whether or not there is any possibility of conflict.

The lengths of the conveyors are design parameters. The lengths of the objects injected are determined by measuring the time difference separating the injection of two consecutive objects by the same injector. In this case the comparator 28, in addition to comparing the addresses L1, L2, has time measuring inputs. It then comprises decoders tabulated according to the theoretical time for an object to reach the conflict area. The conflict indication which it produces then represents the conjunction of addresses relating to the same sorting line and a foreseeable simultaneous presentation of objects in the conflict area.

The provision of the second set of read heads, in addition to providing better detection of double seizures, simplifies the programming of the sorting instructions generated by the instruction circuits 30 and 31.

The invention finds a particularly beneficial application when the injectors are in the form of indexing stations at which a human operator sees pass in front of him objects extracted from a magazine, similar to the magazine 4, for example. The operator reads the information carried by each object. He then enters a code representing the destination of the object using a keyboard console. This code may also be printed by any appropriate means at a suitable location on one side of the object. In all cases, this code is subsequently processed by the control means 6 in the same way as the signal L1 which would otherwise be generated by a read head. Human operators are much slower than an automatic injector feeding objects at a nominal rate, however. To approximate this rate as closely as possible it is known to provide a number of indexing stations in series. A group of indexing stations is thus formed. The cumulative rate of working of the indexing stations of a group tends towards the nominal rate of the sorting machine. To prevent the objects overlapping one another, the indexing stations of a group are synchronized with one another. This means that the dispatching of an object read and indexed is delayed until the outlet conveyor is available. If the conveyor throughput is high, this delay time is not noticed by the operator. The device of the invention in this case enbles the provision of at least two groups of indexing stations working in parallel and both or all feeding the same sorting machine with parallel sorting lines. In this case the total throughput is doubled and for a given quantity of objects to be sorted the task may be executed in half the time.

It will be understood that various changes in the details, materials and arrangements of parts which have been herein described and illustrated in order to explain the nature of the invention may be made by those skilled in the art within the principle and scope of the invention as expressed in the appended claims.

There is claimed:

1. Sorting machine comprising at least two injectors through which objects to be sorted enter the machine, a set of parallel sorting lines, routing stages adapted to link the outlet from each injector to the inlet of each sorting line, respective control means disposed between each injector and said routing stages adapted to sense a destination marker on each object from the respective injector, to designate the sorting line for each object and to command the routing of each object to the appropriate routing stage, and dynamic storage means associated with at least one routing stage of all sorting lines to temporarily store an object from a corresponding injector when the sorting line designated for that object is the same as that designated for another object output by another injector at substantially the same time.

2. Sorting machine according to claim 1, wherein said dynamic storage means comprise means adapted to feed at least one object one by one into a sorting line as soon as that sorting line is not designated for any object from any injector.

3. Sorting machine according to claim 2, wherein said dynamic storage means comprise a hierarchical system of individual storage means each adapted to store a single object and means for restructuring the hierarchy when the highest priority individual storage means has fed an object into the sorting line.

4. Sorting machine according to claim 1, wherein said dynamic storage means comprise at least one set of two object guides, a conveyor belt situated beneath said guides to convey said objects, and a selectively operable barrier on the outlet side of said guides adapted to halt the object in the guides when said barrier is closer and to permit the object in the guides to pass when said barrier is open.

5. Sorting machine according to claim 1, further comprising means for directly routing said objects to the varius sorting lines, said direct routing means linking each injector to the respective sorting lines to procure immediate routing of objects output at the same time from said injectors for those of these objects which have different destinations from one another.

* * * * *